US008123634B1

(12) United States Patent
Lovett

(10) Patent No.: US 8,123,634 B1
(45) Date of Patent: Feb. 28, 2012

(54) PROGRAMMABLE BASKETBALL SHOT SETUP AND RETURN DEVICE

(75) Inventor: Tony L Lovett, Jacksonville, FL (US)

(73) Assignee: Tony LeSean Lovett, Jacksonville, FL (US)

( * ) Notice: Subject to any disclaimer, the term of this patent is extended or adjusted under 35 U.S.C. 154(b) by 315 days.

(21) Appl. No.: 11/683,570

(22) Filed: Mar. 8, 2007

(51) Int. Cl.
*A63B 69/00* (2006.01)

(52) U.S. Cl. ..... 473/433; 473/436; 473/437

(58) Field of Classification Search ..... 473/433, 473/431, 432, 434, 436, 447; 124/26, 78; D21/704; 273/317.3
See application file for complete search history.

(56) References Cited

U.S. PATENT DOCUMENTS

| | | | | |
|---|---|---|---|---|
| 1,211,738 | A * | 1/1917 | Marty | 124/6 |
| 2,445,865 | A * | 7/1948 | Sleeper | 16/35 R |
| 3,776,550 | A | 12/1973 | McNabb | |
| 4,579,340 | A | 4/1986 | Jenkins et al. | |
| 4,667,957 | A | 5/1987 | Joseph | |
| 4,678,189 | A | 7/1987 | Koss | |
| 5,125,653 | A * | 6/1992 | Kovacs et al. | 124/78 |
| 5,215,653 | A * | 6/1993 | Nelson et al. | 208/152 |
| 5,273,275 | A | 12/1993 | Wilkerson | |
| 5,409,211 | A * | 4/1995 | Adamek | 473/433 |
| 5,487,540 | A * | 1/1996 | Bixler et al. | 473/436 |
| 5,681,230 | A | 10/1997 | Krings | |
| 5,746,668 | A | 5/1998 | Ochs | |
| 6,224,503 | B1 | 5/2001 | Joseph | |
| 6,241,628 | B1 | 6/2001 | Jenkins et al. | |

FOREIGN PATENT DOCUMENTS

| | | |
|---|---|---|
| DE | 3709945 | 10/1988 |
| EP | 0 360896 | 4/1990 |

* cited by examiner

*Primary Examiner* — Gene Kim
*Assistant Examiner* — M Chambers

(57) ABSTRACT

An automatic or manually operated basketball return unit with remote control device that is placed under a basketball hoop having a hopper at its top distal end that funnels down to a return tube allowing basketballs to engage a motorized return mechanism which expels the basketball out a return chute and too the user. The return unit comprises a support housing with rotating compression wheels, each having a motor which ejects the ball out an aperture. The unit rotates 180 degrees manually or automatically.

4 Claims, 10 Drawing Sheets

PROGRAMMABLE BASKETBALL SHOT SETUP AND RETURN DEVICE

BACKGROUND OF THE INVENTION

1. Field of the Invention

The present invention relates generally to sports equipment and, more specifically, to an automatic or manually operated basketball delivery and return unit with a remote control.

The unit's ball-input hopper is placed under a basketball hoop where a ball will be directed to a timed ejector unit designed to deliver a plurality of balls in timed sequence to a predetermined location. The deliverer also includes rotation of the device through an arc in conjunction with timed release of a ball. Additionally the present invention has wheels and wheel locks to facilitate for easy movement and placement.

2. Description of the Prior Art

There are return devices designed for sports balls. While these return devices may be suitable for the purposes for which they were designed, they would not be as suitable for the purposes of the present invention, as hereinafter described.

SUMMARY OF THE PRESENT INVENTION

A primary object of the present invention is to provide an automatic or manually operated basketball return unit.

Another object of the present invention is to provide an automatic or manually operated basketball return unit with remote control device.

Yet another object of the present invention is to provide a basket ball return unit that is placed under a basketball hoop having a hopper at its top distal end to receive basketballs.

Still yet another object of the present invention is to provide a basketball return unit having a hopper at its top distal end that funnels down to a return chute allowing a basketball to engage a motorized return mechanism which expels the basketball out of a return chute and to the user.

Another object of the present invention is to provide a basketball return unit that comprises a support housing with rotating compression wheels, each having a motor which ejects the ball out of an aperture.

Yet another object of the present invention is to provide a basketball return unit that rotates 180 degrees manually or automatically.

Additional objects of the present invention will appear as the description proceeds.

The present invention overcomes the shortcomings of the prior art by providing an automatic or manually operated basketball return unit with remote control device that is placed under a basketball hoop having a hopper at its top distal end that funnels down to a return tube allowing basketballs to engage a motorized return mechanism which expels the basketball out a return chute and too the user. The return unit comprises a support housing with rotating compression wheels, each having a motor which ejects the ball out an aperture. The unit rotates 180 degrees manually or automatically.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
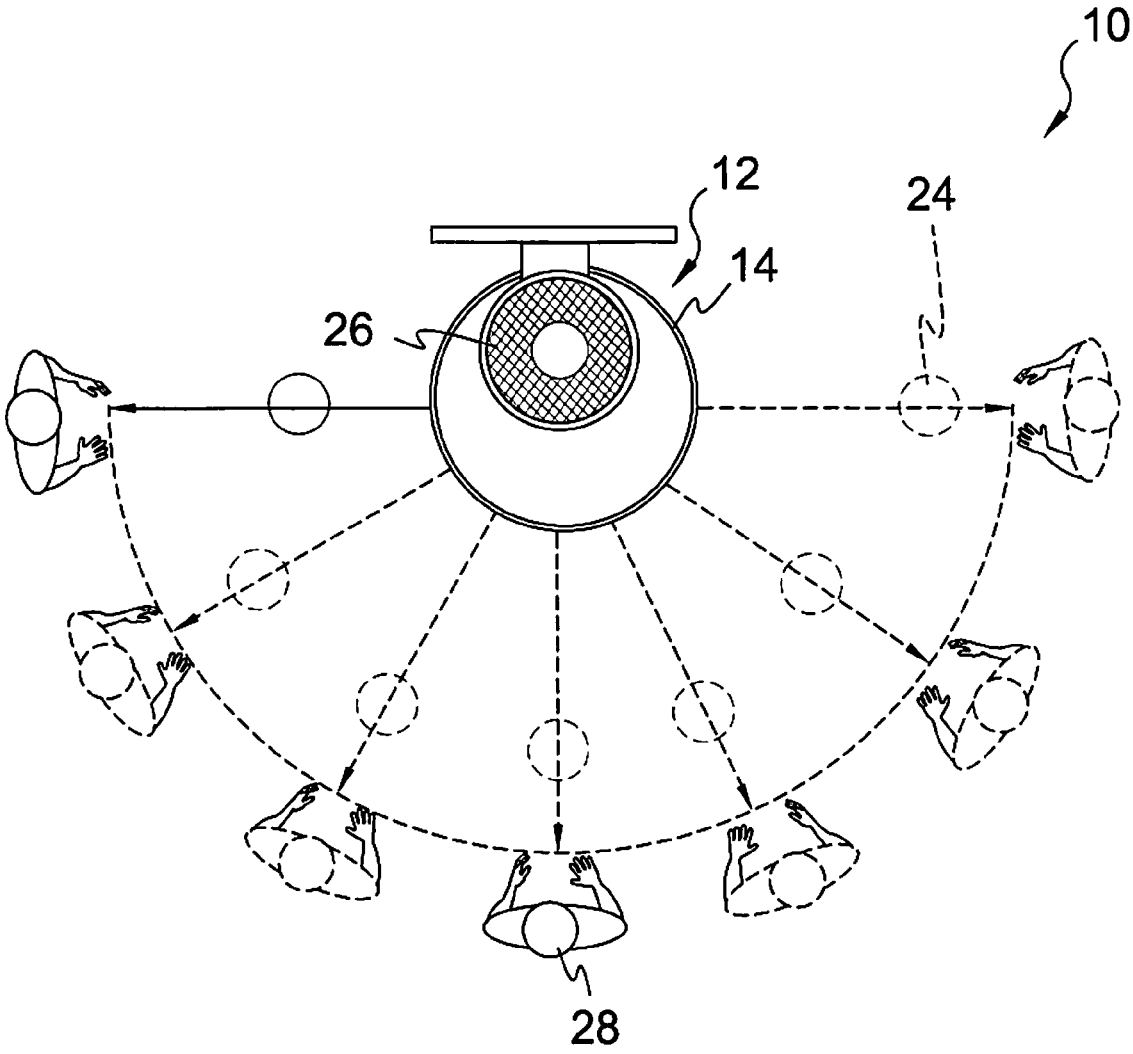
FIG. 1 is a top illustrative aerial view of the present invention in use.

Turning now descriptively to the drawings, in which similar reference characters denote similar elements throughout the several views, the figures illustrate the Programmable Basketball Return Unit with Remote Control of the present invention. With regard to the reference numerals used, the following numbering is used throughout the various drawing figures.

10 Programmable Basketball Return Unit with Remote of the present invention

| | |
|---|---|
| 12 | return unit |
| 14 | hopper |
| 16 | return tube |
| 18 | return channel of 16 |
| 22 | return chute |
| 24 | basketball |
| 26 | basketball rim |
| 28 | user |
| 30 | ball return mechanism |
| 32 | motor of 30 |
| 34 | base of 12 |
| 36 | tube rotation motor |
| 38 | remote control unit |
| 40 | receiver |
| 42 | support bracket of 30 |
| 44 | wiring |
| 46 | actuator |
| 48 | user controls of 38 |
| 50 | timer control |
| 52 | automatic mode control |
| 54 | manual mode control |
| 56 | wheel |
| 58 | wheel lock |
| 60 | wheel lock actuator |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a top illustrative aerial view of the present invention 10 in use. Shown is the basketball return unit 12 in the automatic remote control mode. The basketball return unit hopper 14 is placed under a basketball rim 26. The ball 24 is funneled through a central channel to a motorized return mechanism that expels the basketball 26 in timed intervals out of a return chute that optionally may incorporate angular positioning that may also be remotely controlled. The unit rotates 180 degrees manually or automatically. Shown is the user 28 receiving the ball from a plurality of positions as the return unit 12 ejects the ball 26 while passing through the 180 degree arc.

Figure 2:
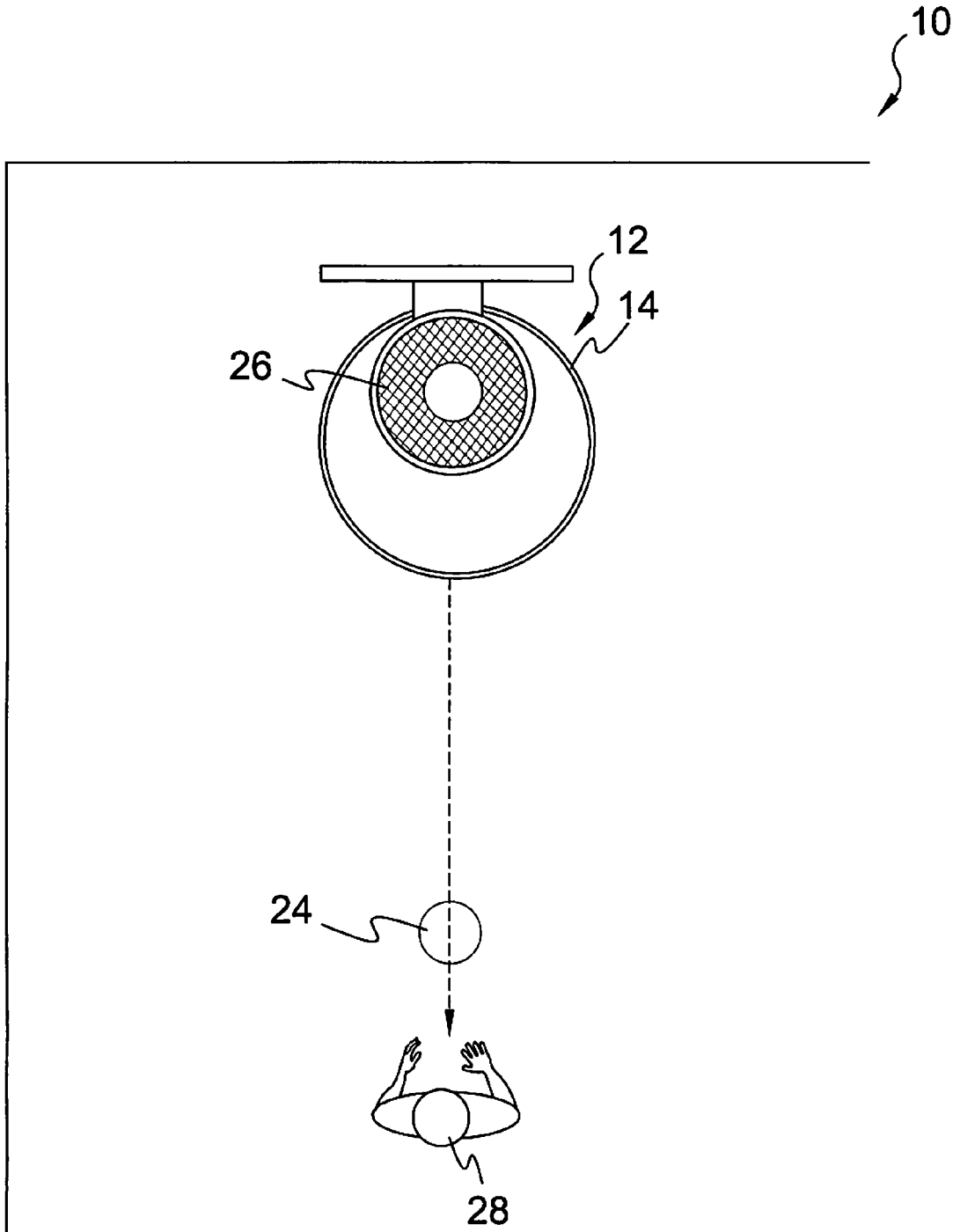
FIG. 2 is a top illustrative aerial view of the present invention in use.

FIG. 2 is a top illustrative aerial view of the present invention 10 in use. Shown is the return unit 12 in manual mode. The hopper 14 is positioned under a basketball rim 26 to funnel the ball 24 to a timed ejector mechanism and back to the user 28. There is no rotation of the return tube and its associated return chute while in manual mode.

Figure 3:
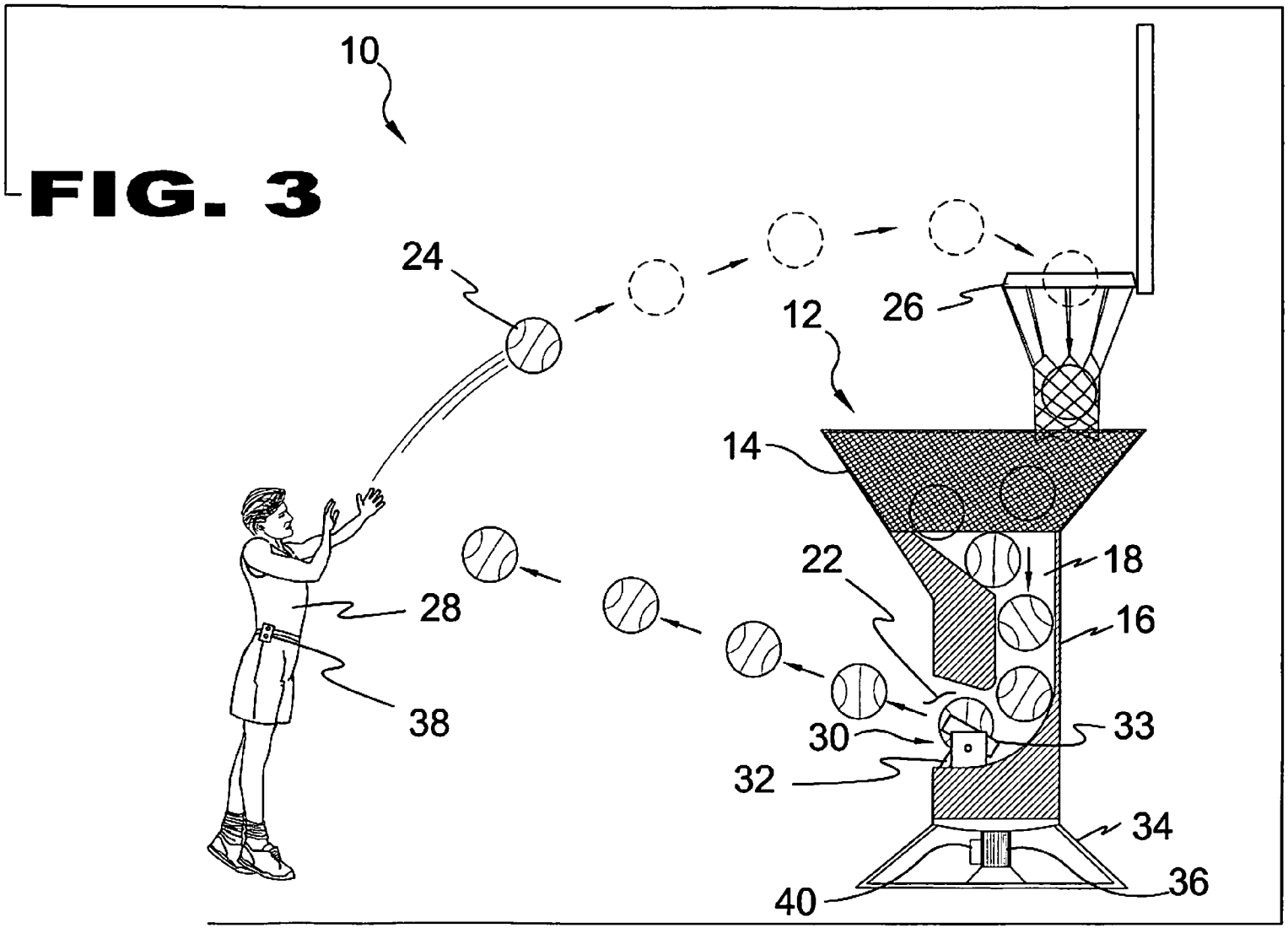
FIG. 3 is an illustrative/sectional view of the present invention in use.

FIG. 3 is an illustrative/sectional view of the present invention 10 in use. The return unit 12 is positioned so the hopper 14 is disposed beneath the basket rim 26. A shot ball 24 passing through the rim 26 falls into the hopper 14 and drops through a return channel 18 extending through the return tube 16. Upon reaching the bottom of the return channel 18 the ball 24 is introduced to a ball return mechanisms 30 comprising a pair of compression wheels 33 with each having its own motor 32 to rotate them in opposite directions to enable them to eject the ball through a return chute 22 disposed on the side of the return tube 16. A base 34 is provided at the bottom of the return tube 16 for stabilizing the return unit 12 and housing a motor 36 for rotating the return tube 16. A receiver 40 is in communication with the return tube motor 36 and a remote control 38 for varying parameters remotely.

Figure 4:
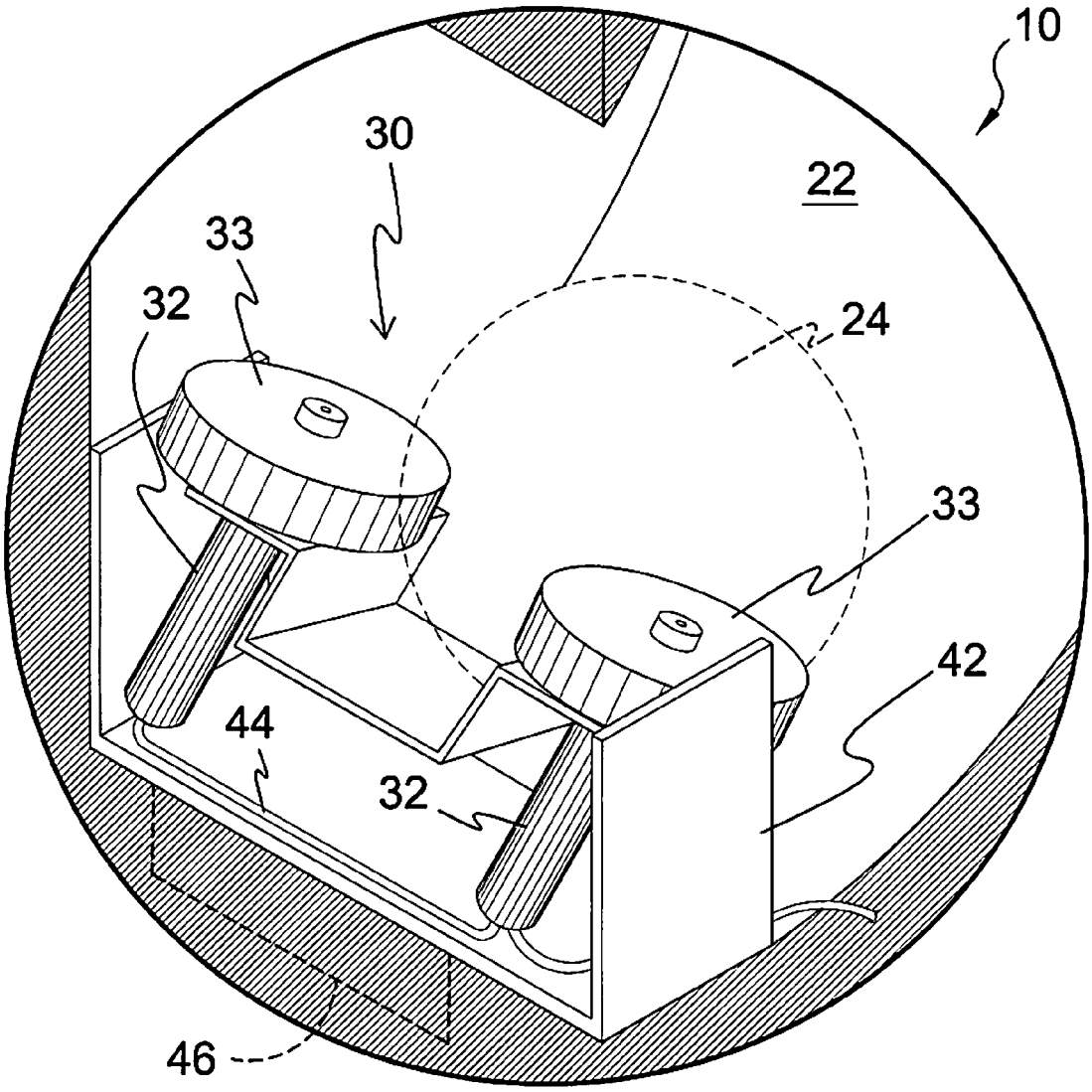
FIG. 4 is a detailed view of the return unit of the present invention.

FIG. 4 is a detailed view of the return mechanism 30 of the present invention 10. Shown is the basketball 24 timed return mechanism 30 wherein the ball 24 falls into the hopper and is channeled to the return chute 22 and return mechanism's 30 motorized compression wheels 33 in timed intervals, each compression wheel 33 has its own motor 32 and the ball 24 is ejected from the return chute 22 by the compression wheels 33. The unit is capable of holding a number of basketballs 24 waiting to be dispensed. Optionally provided is an actuator 46 to vary the pitch of the support bracket 42 thereby changing the angle and distance of the ejected basketball 24

Figure 5:
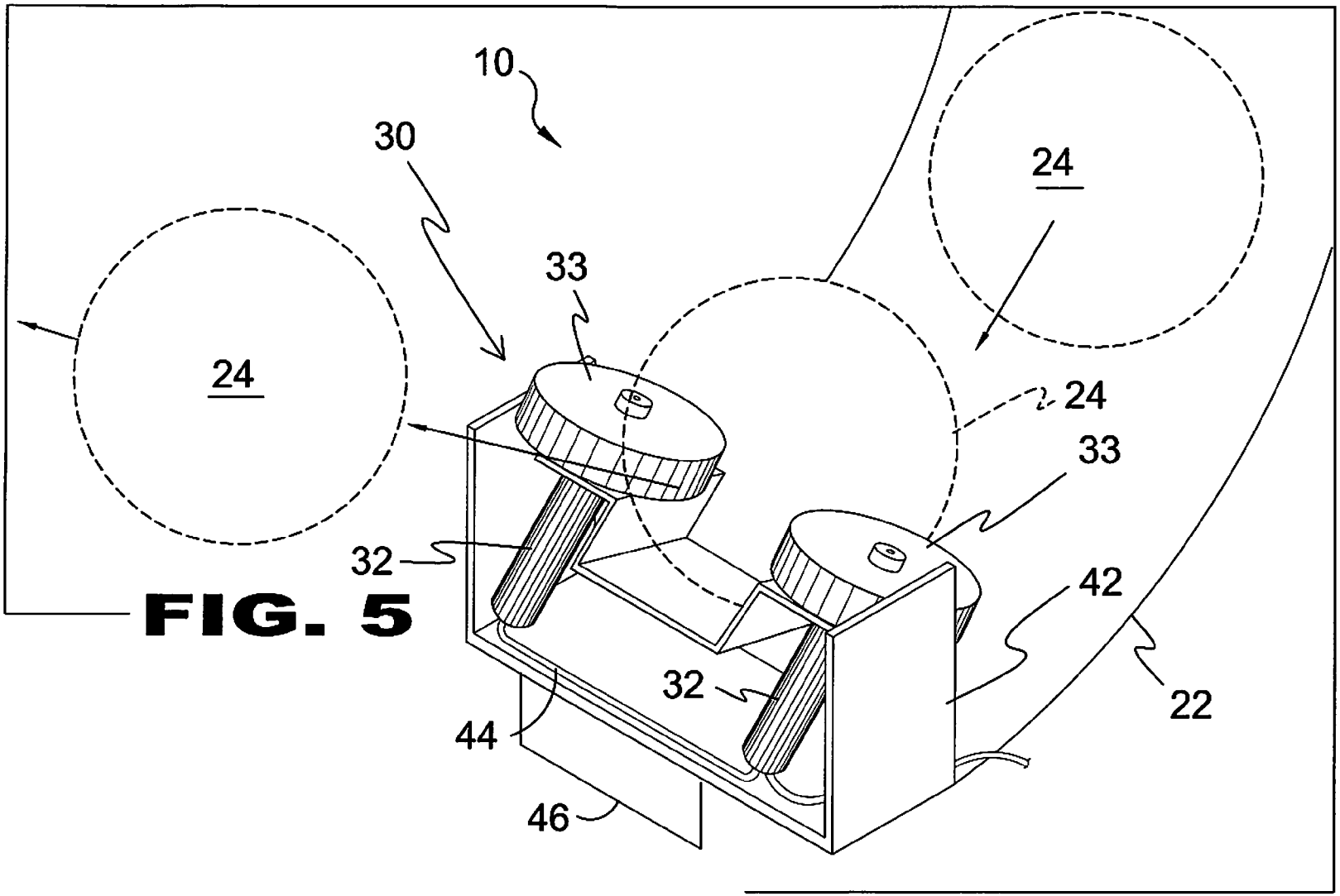
FIG. 5 is ball movement in the return unit of the present invention.

FIG. 5 is ball movement in the return chute 22 of the present invention 10. Shown is the basketball 24 timed return mechanism 30 wherein the ball 24 falls into the hopper and is channeled to the return chute 22 and return mechanism's 30 motorized compression wheels 33 in timed intervals, each compression wheel 33 has its own motor 32 and the ball 24 is ejected from the return chute 22 by the compression wheels 33. The unit is capable of holding a number of basketballs 24 waiting to be dispensed. Optionally provided is an actuator 46 to vary the pitch of the support bracket 42 thereby changing the angle and distance of the ejected basketball 24

Figure 6:
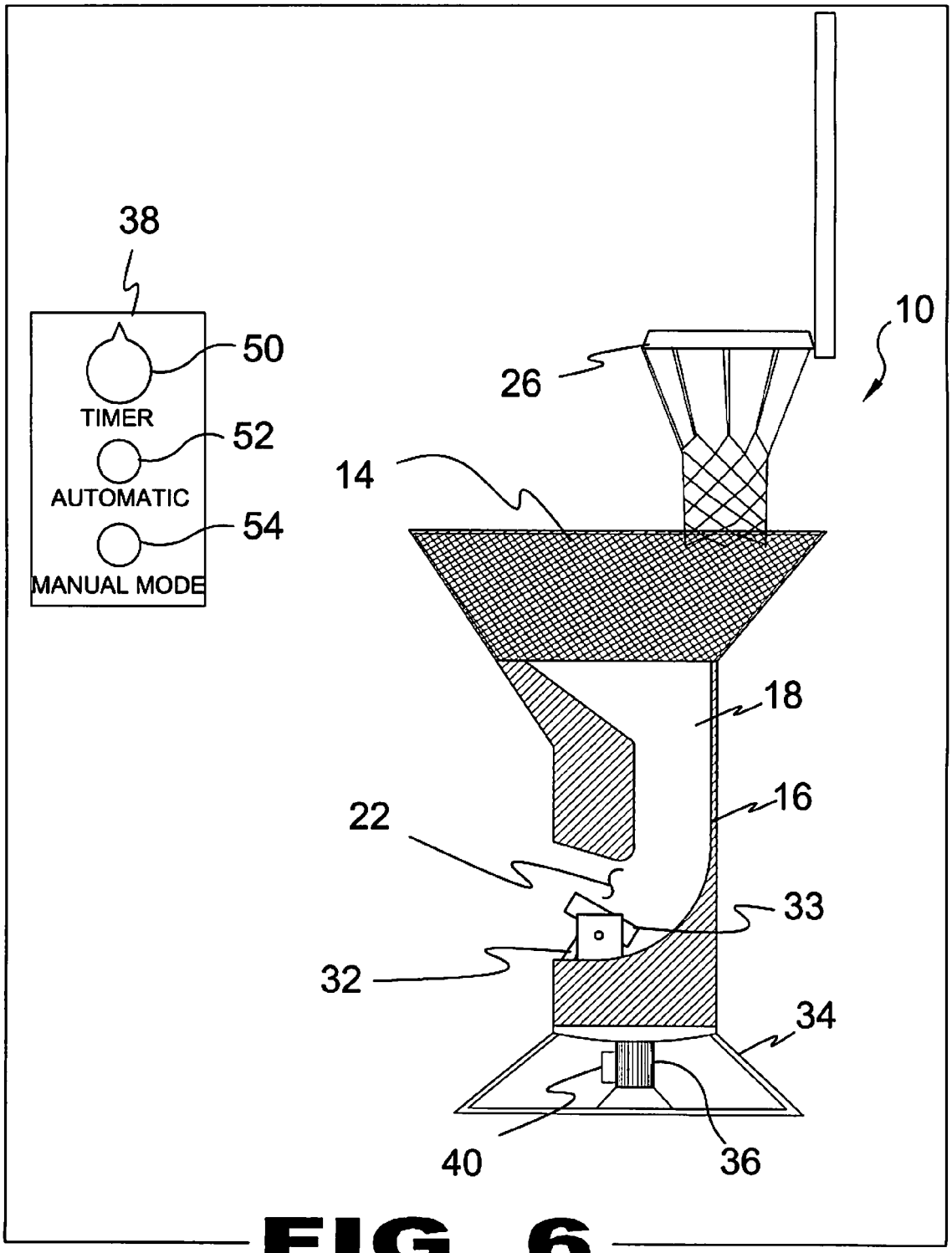
FIG. 6 is a sectional view of the present invention.

FIG. 6 is a sectional view of the present invention 10. The return unit 12 is positioned so the hopper 14 is disposed beneath the basket rim 26. A shot ball passing through the rim 26 falls into the hopper 14 and drops through a return channel 18 extending through the return tube 16. Upon reaching the bottom of the return channel 18 the ball is introduced to a ball return mechanisms 30 comprising a pair of compression wheels 33 with each having its own motor 32 to rotate them in opposite directions to enable them to eject the ball through a return chute 22 disposed on the side of the return tube 16. A base 34 is provided at the bottom of the return tube 16 for stabilizing the return unit 12 and housing a motor 36 for rotating the return tube 16. A receiver 40 is in communication with the return tube motor 36 and a remote control 38 for varying parameters remotely. User controls 48 on the remote control unit 38 enable the user to adjust between manual 54 and automatic 52 modes and vary the speed of the timer 54 as desired.

Figure 7:
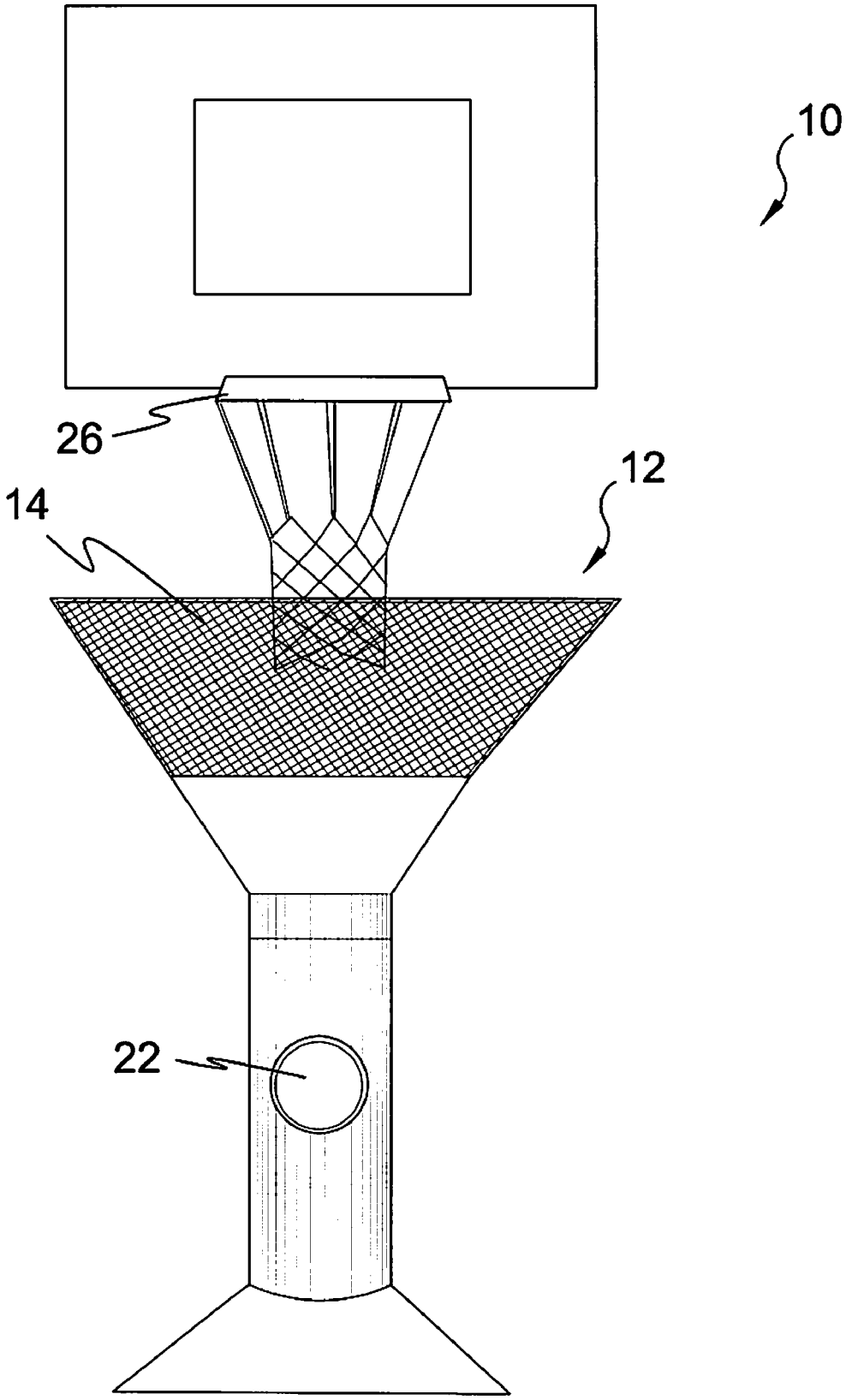
FIG. 7 is a frontal view of the present invention placed under a basketball hoop.

FIG. 7 is a frontal view of the present invention 10 placed under a basket ball rim 26. Shown is the basketball return unit 12 of the present invention 10 set up under a basketball rim 26. The user shoots basketballs into a basketball hoop 26, as the ball (s) fall through the hoop 26, it enters the return unit 12 through the hopper 14 and is funneled down to a return mechanism which ejects the basketball out the return chute 22 and back to the user.

Figure 8:
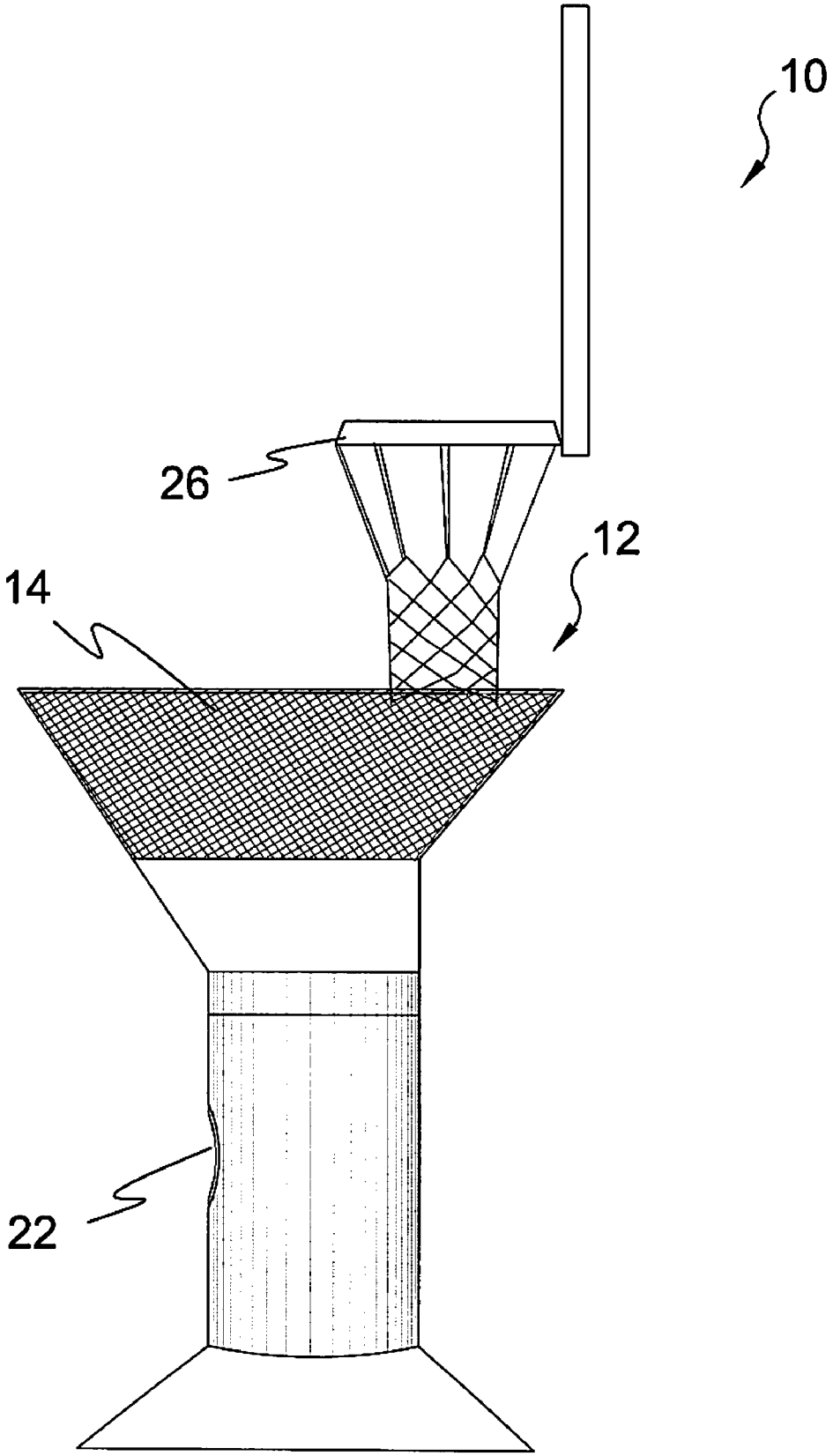
FIG. 8 is a side view of the present invention placed under a basketball hoop.

FIG. 8 is a side view of the present invention 10 placed under a basket ball hoop 26. Shown is the basketball return unit 12 of the present invention 10 set up under a basketball hoop 26. The user shoots basketballs into a basketball hoop 26, as the ball (s) fall through the hoop 26, it enters the return unit 12 through the hopper 14 and is funneled down to a return mechanism which ejects the basketball out the return chute 22 and back to the user.

Figure 9:
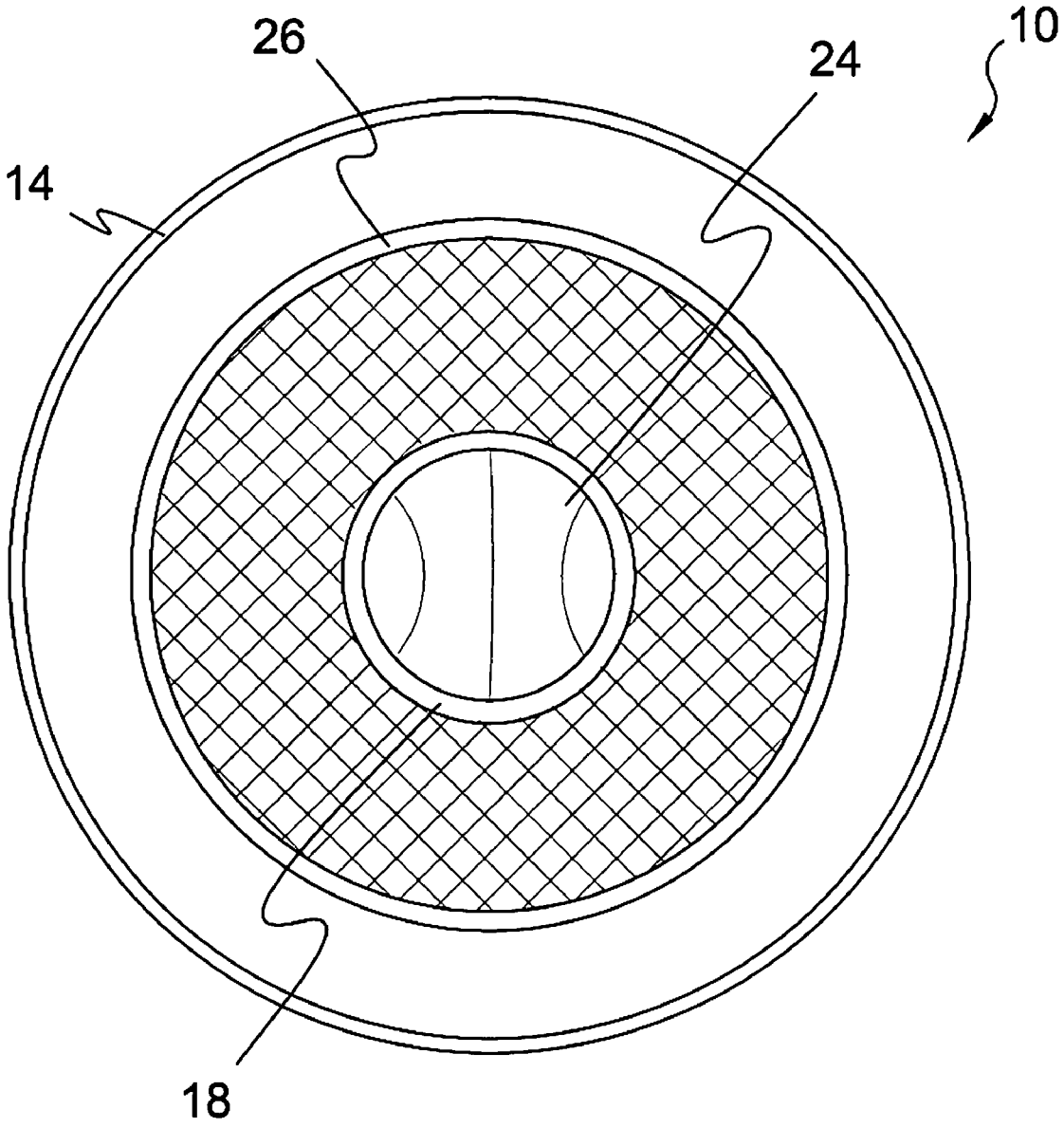
FIG. 9 is a top view of the present invention.

FIG. 9 is a top view of the present invention 10. Shown is a top view of the basketball return unit of the present invention 10 having hopper 14 leading to a return channel 18 extending therethrough that funnels down a return tube allowing basketballs 24 to engage a motorized return mechanism which expels the basketball out a return chute and too the user. The unit rotates 180 degrees manually or automatically.

Figure 10:
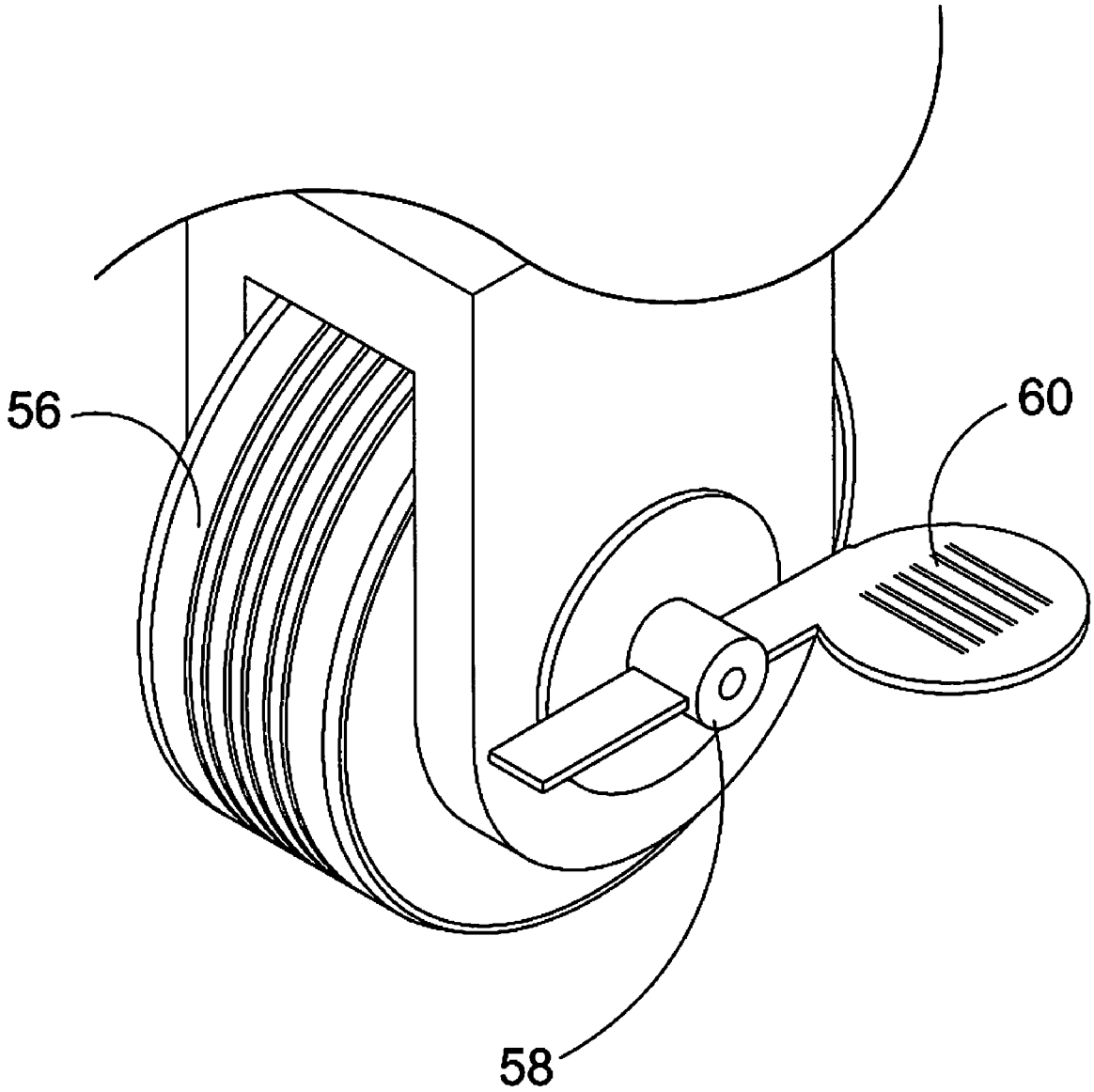
FIG. 10 is a detailed view of the wheel locks of the present invention.

FIG. 10 is a detail view of the wheel lock assembly. The wheels 56 enable the user to move the unit from one location to another and apply the wheel locks 58 via the actuator 60 to prevent the inadvertent movement thereof.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A programmable basketball return unit comprising:

a) a hopper located under a backboard for receiving a shot basketball;

b) a ball return mechanism including compression wheels for delivering said basketball back to a user, said compression wheels being oppositely facing on a horizontal plane supported by a support bracket;

c) a vertical return tube having a return channel communicating between said hopper and said ball return mechanism;

d) a stationary base for supporting said ball return mechanism, vertical return tube and hopper;

e) a motor mounted in said base for selectively rotating said ball return mechanism and vertical return tube on said base within a reciprocating 180 degree arc to deliver basketballs to a plurality of locations;

f) an actuator for varying the pitch of the support bracket for changing the angle and distance of an ejected basketball;

g) a receiver in said base for receiving wireless control signals; and h) a remote control unit carried by said user for sending control signals to said receiver for controlling parameters of said basketball return unit, said remote control unit including a timer for determining a rate of ball ejection from said return chute, an automatic mode in which said return tube is rotating back and forth within a range of a 180 degree arc as the balls are being delivered, and a manual mode of operation wherein said return tube is not rotating and the balls are delivered to only one location and wherein a said return channel descends through said return tube and terminates at a return chute that turns toward a side of said return tube and provides a point of egress therefrom wherein said compression wheels are disposed within said return chute and wherein said means ball return mechanism comprises:

a) said compression wheels comprising a pair of opposing wheels; and b) a motor for each compression wheel that serve rotate said wheels in opposite directions in a manner facilitating the surface of each wheel facing the other to spin towards the point of egress of said return chute.

2. The programmable basketball return unit recited in claim 1, wherein said compression wheel motors are mounted in said support bracket.

3. The programmable basketball return unit recited in claim 2, wherein said return channel can store a plurality of balls at a given time.

4. The programmable basketball return unit recited in claim 3, wherein said base member further includes a plurality of wheels with wheel locks that are engaged and disengaged via a pivotable actuator.

* * * * *